United States Patent [19]

Schmitz et al.

[11] 4,355,488

[45] Oct. 26, 1982

[54] CRYOGENIC DEFLASHING METHOD

[75] Inventors: Robert E. Schmitz, Santa Ana; David T. Stearns, Turtle Rock; Erwin Stegmann, Tustin, all of Calif.; Thomas E. McWhorter, Whitehall; Warren F. Geiger, Ft. Washington, both of Pa.; Thomas J. Abrahamsen, Kloster, N.J.

[73] Assignee: Air Products and Chemicals, Inc., Allentown, Pa.

[21] Appl. No.: 111,783

[22] Filed: Jan. 14, 1980

[51] Int. Cl.[3] ..... B24B 1/00

[52] U.S. Cl. ..... 51/319

[58] Field of Search ..... 51/417, 426, 318–321

[56] References Cited

U.S. PATENT DOCUMENTS

| | | | |
|---|---|---|---|
| 1,544,519 | 6/1925 | McKinley | 51/417 |
| 2,344,476 | 3/1944 | Turnbull | 51/417 |
| 3,160,993 | 12/1964 | McCormick | 51/417 UX |
| 3,434,241 | 3/1969 | Greenberg | 51/417 |
| 3,898,768 | 8/1975 | Gilbert | 51/417 |
| 4,164,103 | 8/1979 | Hesse | 51/417 |

*Primary Examiner*—Harold D. Whitehead

*Attorney, Agent, or Firm*—Richard A. Dannells, Jr.; E. Eugene Innis

[57] ABSTRACT

A cryogenic deflashing apparatus is provided specifically adapted to remove residual flash from relatively large molded articles in a continuous high production deflashing operation. The apparatus incorporates a modular deflashing housing wherein entry, pre-freezing, blasting, and exit of multiple articles is accomplished simultaneously in discrete serially aligned operational compartments. A novel article conveyor transport mechanism is additionally provided which permits the transport speed of the articles through the various compartments to be independently varied during operation to maximize production efficiency.

1 Claim, 6 Drawing Figures

10
12
14
16
18
22
30
32
34
36
40
42
44
46
50
60
70
72
80
82
84
86
88
92
94
100
102
104p
104s
106p
106s
108p
108s
110
112
114
116p
116s
120a
120b
120c
120d
140a
140b
140c
140e
140f
160p
160s
2

CRYOGENIC DEFLASHING METHOD

BACKGROUND OF THE PRESENT INVENTION

The present invention relates to cryogenic deflashing method, and more particularly to cryogenic deflashing method specifically adapted to remove residual flash from relatively large molded articles in a high production continuous deflashing operation. By "relatively large" size is meant such articles as automobile bumper units, steering wheels, fan shrouds, etc.

In recent years, cryogenic deflashing apparatus has been introduced on the market which, in many instances, has eliminated the requirement of costly hand trimming of residual flash from molded rubber and/or plastic manufactured items. Basically, such cryogenic deflashing apparatus comprise a chamber maintained at an extremely low temperature by use of a cryogen gas, such as nitrogen, into which is introduced a high velocity stream of deflashing media, typically steel, rubber, or plastic pellitized shot. Molded articles of relatively small size, e.g., O-rings, grommets, bushings, etc., are emplaced within the chamber wherein, due to the relatively greater thickness of the molded article compared to the residual flash thereon, only the residual flash becomes embrittled in the low temperature environment. In its embrittled state, the flash is rapidly separated from or broken off of the article by the impact of the high velocity deflashing media stream. By controlling the exposure duration of the molded articles within the cryogen environment, as well as the velocity and dispersion of the deflashing media thereagainst, it has been found that highly satisfactory and economical article deflashing may be accomplished at a fraction of the cost of hand trimming.

The existing state of the art apparatus has typically incorporated an insulated cryogenic deflashing chamber having means, such as a rotating belt, for continuously exposing the residual flash on the molded articles beneath the high velocity media stream. Due to the substantial safety hazards associated with the cryogenic environment, some of the apparatus has additionally included various enclosure or housing designs adapted to permit the molded articles to be inserted and removed from the deflashing chamber, while limiting atmosphere/cryogen interaction. Although such state-of-the-art devices have proven extremely useful in their limited application, they possess certain inherent deficiencies which have detracted from their overall utility and production capability.

Foremost of these deficiencies has been the inability of the prior art deflashing apparatus to disperse a uniform media pattern throughout a relatively large deflashing chamber so as to accommodate relatively large molded articles. Also the tumbling belts do not continually expose multiple large size articles directly with the impinging media stream. Inconsistent and unsatisfactory article deflashing is produced by this lack of constant exposure of the articles to a uniform, wide dispersion media stream.

Further, the prior art deflashing apparatus has typically required that the loading, freezing, blasting, and unloading of the articles within the apparatus be accomplished in sequential independent operations. Thus, the actual deflashing process is inoperative during loading and unloading of articles as well as during the initial exposure duration of the molded articles within the cryogen environment.

In addition, there are particular problems associated in the deflashing of relatively large articles which have neither been recognized nor addressed in the prior art deflashing apparatus. Thus, mold tolerances for large sized articles typically cannot be maintained within the narrow limits customary in relatively small sized molds, thereby causing greater thickness and larger size residual flash to be present on the molded articles. Such larger sized flash is not only more difficult to be removed during media bombardment, but typically breaks off the article in large segments or strands which may become lodged within a tumbling belt mechanism or accumulate within the various media transport systems. In addition, large pieces of flash, if not removed from the tumbling belt, may shield the articles from direct impact with the deflashing media and thereby reduce the overall efficiency of the deflashing process.

Also, relatively large sized flash requires increased exposure duration within the cryogen environment to become suitably embrittled. Due to the pre-cooling and deflashing operations being independent and sequential in the existing prior art apparatus, such increased exposure time to the cryogen environment would substantially increase the overall production time of the deflashing operation.

Additionally, the handling and transport problems associated with large articles are significantly increased. Manual loading and unloading of such articles within the cryogen environment poses severe safety hazards to operating personnel. The state-of-the-art technology, has therefore not provided means for satisfactorily deflashing relatively large molded articles nor even addressed the significant health, transport, and production problems inherent in their size. As a result, the vast majority of large molded articles are hand trimmed which substantially increases the cost of these articles to the ultimate consumer.

SUMMARY OF THE PRESENT INVENTION

The present invention eliminates the above deficiencies of the prior art apparatus and particularly addresses the peculiar problems associated in the deflashing of relatively large sized molded articles. Specifically, the present invention utilizes a continuous conveyor transport for automatically transporting multiple large sized molded articles and a modular deflashing housing wherein entry, pre-cooling, blasting, and exit of multiple articles within the apparatus occurs simultaneously in discrete serially aligned operational compartments within the modular housing.

The continuous conveyor transport of the present invention comprises an overhead, closed loop conveyor system which includes multiple part carriers depending therefrom, each adapted to carry one or more articles thereon. The conveyor system is powered by a mechanical drive which automatically transports each of the part carriers through the modular deflashing housing in a successive manner, whereby each of the carriers is selectively disposed in one of the operational compartments. Further, the transport system includes loading and unloading stations which are remotely located from the modular deflashing housing, thereby eliminating exposure of the cryogen environment maintained within the deflashing housing to operating personnel.

The modular cryogenic deflashing housing of the present invention comprises an elongate, thermally insulated structure which is delineated into discrete operational compartments or work stations. Each of the compartments is serially aligned with an adjacent compartment and adapted to perform successive independent operations upon the molded articles. As such, during transport through the modular housing, multiple molded articles are successively entered, pre-freezed, media blasted, and exited from the housing, with each of the independent operations occurring simultaneously in a respective operational compartment.

In the preferred embodiment, the initial compartment or work station of the housing forms an entry module which serves as a buffer region to prevent direct interaction between ambient air and the cryogen environment. The entry module is provided with a pair of inner and outer pivotal doors which selectively isolate the module from both ambient air and the cryogen environment maintained within the housing. The doors are adapted to open and close in succession so that during entry of the part carrier into the module, the inner doors remain closed while the outer doors are cycled open and during exit from the module, the outer doors remain closed while the inner doors are cycled opened. By this arrangement, the cryogen environment is never directly exposed to ambient air.

From the entry module the part carrier is transported into the second compartment or pre-freeze module, the interior of which is maintained within the cryogen environment. During travel through the pre-freeze module, the articles are initially exposed to the cryogen environment whereby the residual flash thereon is rapidly embrittled. After a sufficient period of time in the pre-freeze module, the part carrier is transported into the third compartment or blasting module, additionally maintained within the cryogen environment, wherein a high velocity deflashing media is bombarded against the articles. Depending upon the configuration complexity of the molded article, as well as the thickness and size of flash thereon, the part carrier can be transported into a secondary blasting module wherein additional deflashing media may be impacted against the articles. To increase the speed of the deflashing operation, differing sized deflashing media (i.e., course and fine) may be utilized in the primary and secondary blasting modules, whereby the molded articles are roughly deflashed in the primary blasting module (i.e., the majority of flash being removed therefrom) and subsequently finely deflashed in the secondary blasting module.

Subsequent to the blasting operation, the part carrier is transported into the last compartment or exit module which, as with the entry module, includes a pair of inner and outer doors which selectively isolate the module from the cryogen environment and ambient air. Thus, during transport of the part carrier through the exit module, the inner and outer doors are successively and independently cycled opened and closed to permit the part carrier to be removed from the deflashing housing with only limited interaction between the cryogen environment and ambient atmosphere. By such a housing arrangement, each of the compartments or modules of the apparatus may simultaneously receive an individual part carrier having articles placed thereon, and simultaneously perform a respective operation, thereby eliminating the non-productive loading, unloading, and cooling cycles associated in the prior art devices and thus significantly reducing overall production time.

To augment the high production capability of the present invention, the conveyor transport mechanism is additionally adapted to permit independent speed control of the part carrier travel within each of the different compartments or modules within the deflashing housing. Additionally, each of the blasting modules is provided with means for selectively rotating an individual part carrier maintained therien, to expose all sides of the molded articles directly with the high velocity deflashing media stream. Further, the dispersion pattern of the deflashing media within the blasting modules may be independently adjusted to insure that a uniform media pattern is applied throughout the height of the module. As such, the present invention may be quickly adapted to accommodate differing sized and shaped articles and insure proper deflashing within the apparatus.

Further, to prevent any escape of the cryogen environment at the interface between the conveyor transport mechanism and the modular deflashing housing, a novel sealing arrangement is disclosed which readily accommodates the substantial thermal stresses presented between ambient air and a cryogen environment while permitting transverse and rotational movement of the part carrier through the deflashing housing.

DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
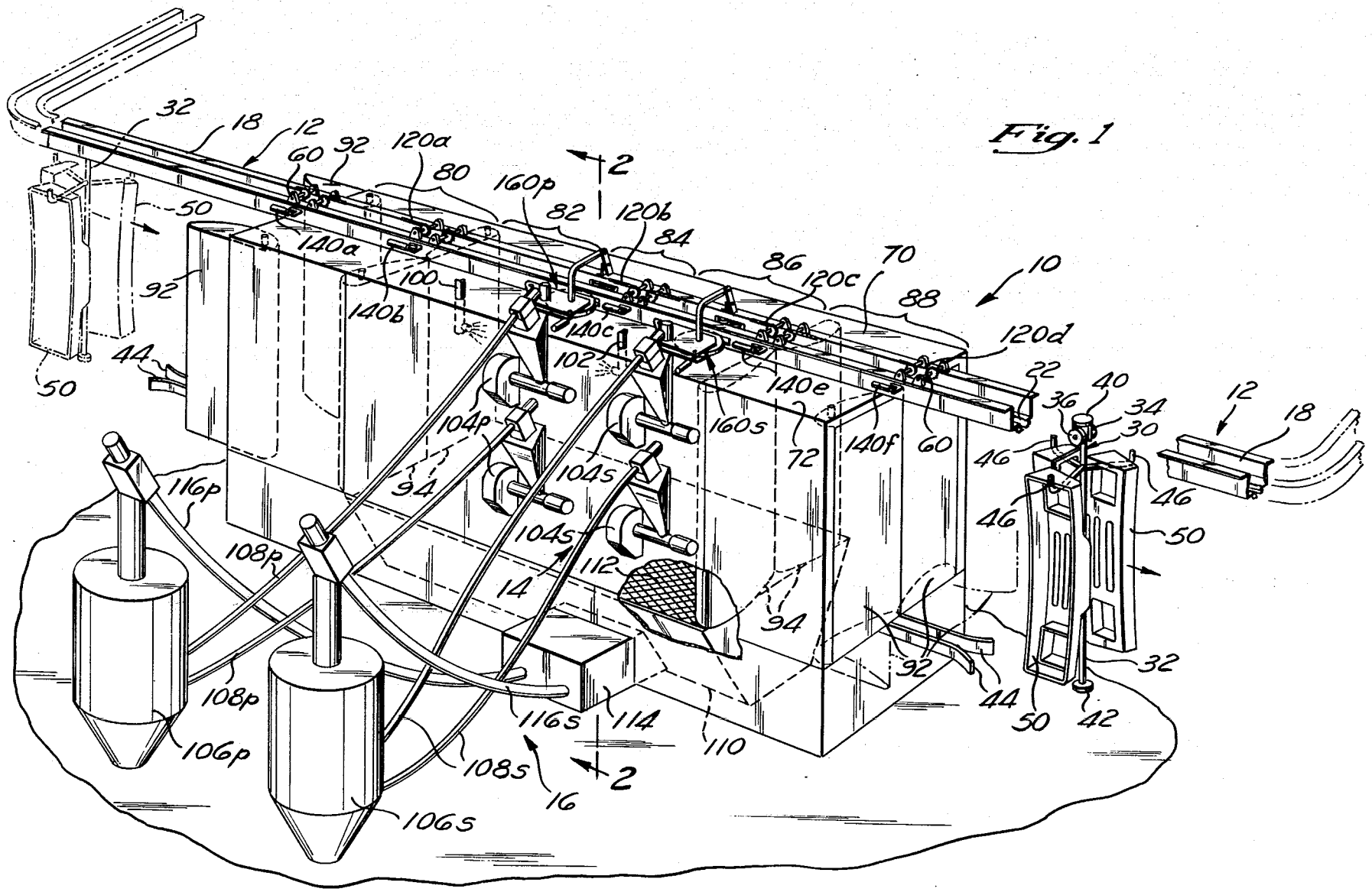
FIG. 1 is a perspective view of the deflashing apparatus of the present invention illustrating the preferred construction and spacial relationship between the conveyor transport mechanism and the modular deflashing housing.

Referring to FIG. 1, there is shown the improved cryogenic deflashing apparatus 10 of the present invention, composed generally of a part conveyor transport 12, a modular deflashing housing 14, and a media separator, storage, and supply system 16. The part conveyor transport 12 comprises a generally U-shaped channel or track 18, preferably formed in a closed loop configuration and suspended by suitable means (not shown) from the ceiling structure of a plant facility. The lower surface 20 of the track 18 is adapted to register plural part carriers 30 within the track 18 and includes a central elongate slot 22 extending axially throughout its length.

Figure 4:
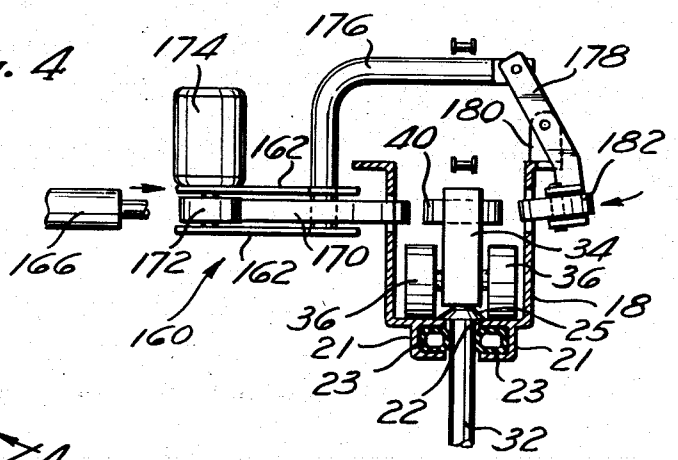
FIG. 4 is a cross-sectional view taken about lines 4—4 of FIG. 3 illustrating the operation of the rotating mechanism of FIG. 3.
Figure 3:
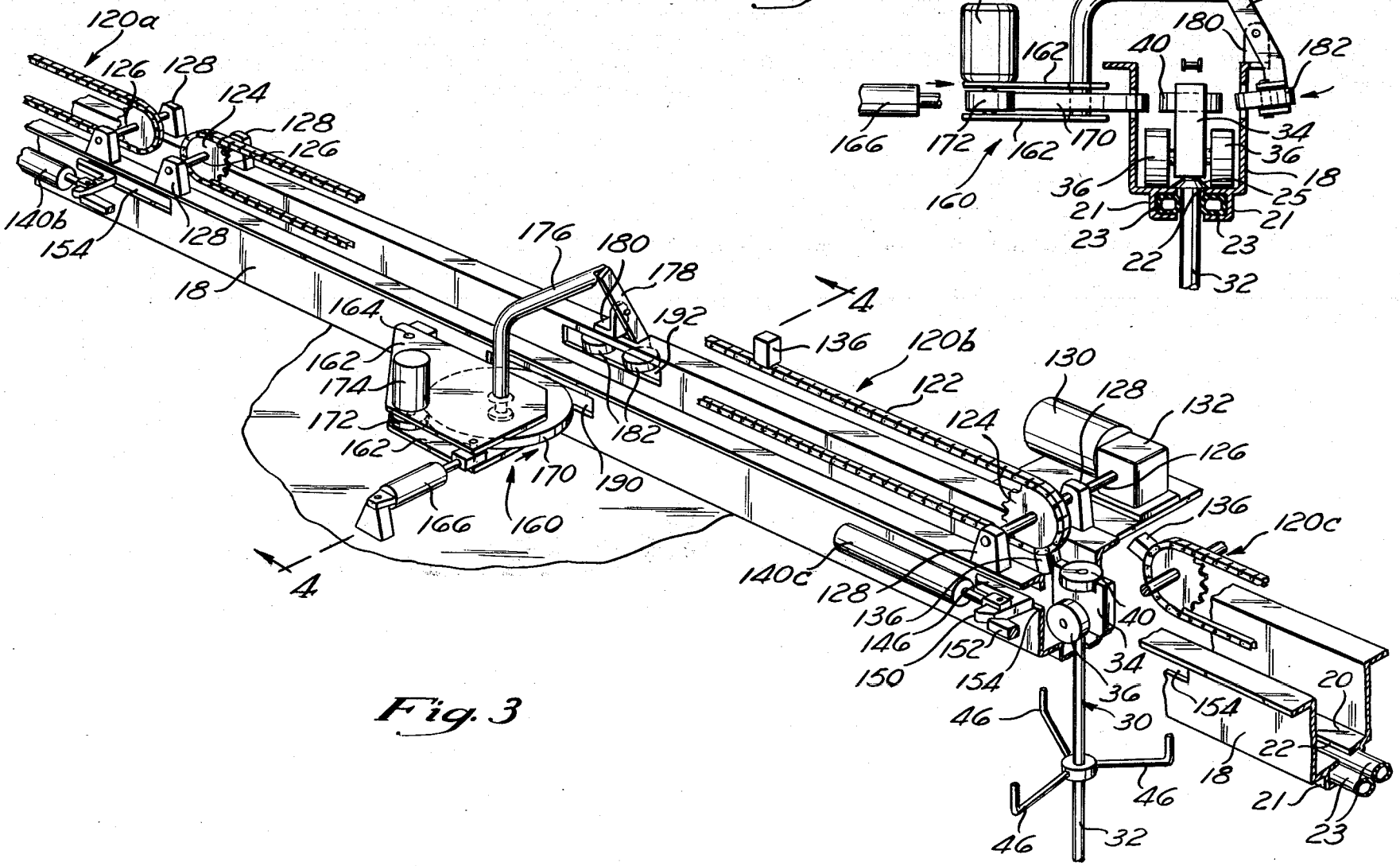
FIG. 3 is an enlarged, partial perspective view of the independent drive mechanisms of the conveyor transport utilized to synchronously transport the depending part carriers through each of the individual operational modules of the deflashing housing, and illustrating the rotating mechanism utilized to selectively rotate the part carriers within the blasting modules.

As best shown in FIGS. 3 and 4, the part carriers 30 are formed having an elongate central rod 32 which depends from a trolley 34 including a pair of horizontally disposed rollers 36. The diameter of the rod 32 is sized slightly less than the width of the elongate slot 22 formed in the track 18 while the distance across the rollers 36 is maintained less than the width of the track 18. As such, the rollers 36 are supported upon the lower surface 20 of the track 18 and may roll thereon to permit the carrier 30 to travel transversely throughout the length of the track 18.

In the preferred embodiment, the rod 32 extends vertically through the trolley 34, being rotably mounted thereto by suitable bearings (not shown) and including an enlarged diameter disk 40, rigidly mounted to its upper-most end. The lower end of the rod 32 is additionally provided with a bearing 42, the outside diameter of which is sized to be received between a pair of spaced guide rails 44 extending through the length of the modular deflashing housing 14.

Rigidly attached adjacent the upper end of the rod 32 are one or more article support arms 46 each adapted to removably mount a particular molded article 50 to be deflashed. In the preferred embodiment, the rod 32 is formed having a length of approximately 15 feet, such that relatively large articles 50 (such as automobile bumper and grill units) may be accommodated thereon.

Figure 2:
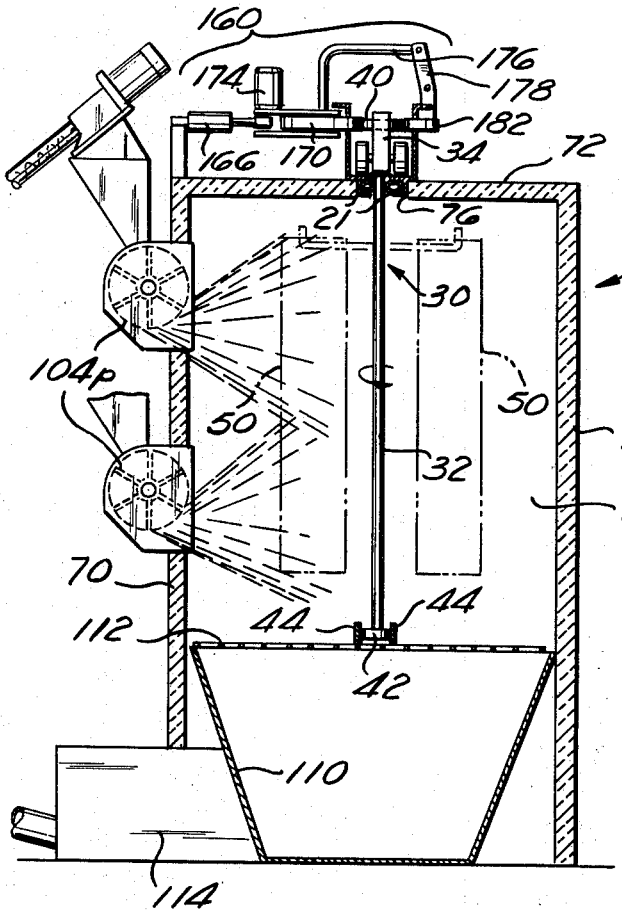
FIG. 2 is a cross-sectional view taken about lines 2—2 of FIG. 1, illustrating the interface between the conveyor transport and the deflashing housing, and the manner in which the part carrier travels through the blasting module.
Figure 5:
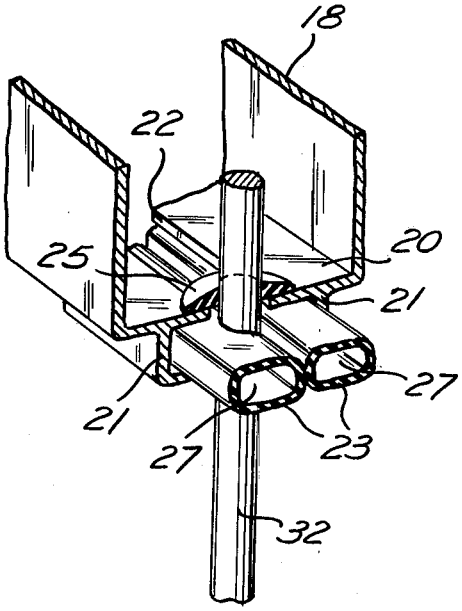
FIG. 5 is an enlarged partial perspective view of the seal formed at the interface between the conveyor transport and the deflashing housing which prevents the escape of cryogen gas from the deflashing housing into ambient air.

Referring to FIGS. 2 and 5, it may be seen that the lower surface 20 of the track 18 additionally includes a pair of elongate L-shaped flanges 21 which are spaced on opposite sides of the central slot 22 extending completely through the length of the deflashing housing 14 and terminating a short distance outboard therefrom. A pair of closed end inflatable elastomeric tube seals 23 are disposed within each of the flanges 21 and are maintained tightly against the lower surface 20 of the track 18. The width of the seals 23 is sized so that the seals 21 tightly abut one another to form an effective seal extending beneath the elongate central slot 22 of the track 18. Due to the resiliency of their elastomeric material, the seals 21 selectively deform (i.e., spread) to receive the rod 32 of the part carrier 30, thereby permitting rotational as well as transverse travel of the carrier 30 while maintaining the seal across the slot 22. A resilient disk washer 25 is additionally mounted to the upper end of the rod 32 to augment the seals 23 in the specific deformation area of the rod 32/seal 23 interface. Due to the seals 23 including a stagnant or dead air space 27 within their interior, they remain resilient when subjected to the temperature differential between ambient air and the cryogen environment, thereby maintaining an effective seal across the elongate slot 22.

The conveyor transport 12 includes a main chain drive (represented schematically in FIG. 1 and designated generally by the numeral 60) which is formed in a conventional manner and is positioned upon the upper surface of the track 18 to mechanically transport the trolleys 34 of the part carriers 30 toward and away from the deflashing housing 14. As shown in FIG. 1, the main chain drive 60 initiates and terminates adjacent opposite ends of the deflashing housing 14, thereby being utilized to transport the part carriers 30 only along the section of the track 18 which is remote to the deflashing housing 14. As will be explained in more detail infra, multiple independent transport mechanisms 120*a*–120*d* are utilized to transport the part carriers 30 within the deflashing housing 14, such that the transport speed may be independently controlled through each of the operational compartments of the modular housing 14.

Referring particularly to FIGS. 1 and 2, it may be seen that the modular housing 14 is composed of an elongate casing 70, preferably having an insulated double wall construction, the top surface 72 of which supports a portion of the U-shaped track 18. A slot-like opening 76 extends throughout the length of the top surface 72 and is sized to tightly receive the L-shaped flanges 21 of the track 15, thereby forming a sealed interface between the track 18 and the top surface 72 of the deflashing housing 14.

The interior of the housing 14 is spacially segregated into a plurality of discrete compartments or work stations, comprising the entry module 80, pre-freeze module 82, primary blasting module 84, secondary blasting module 86, and exit module 88, each of which is adapted to permit independent and serial operations to be performed upon the articles 50 during transport therethrough. Both the entry module 80 and exit module 88 are provided with a pair of thermally insulated doors 92 and 94, pivotally mounted at opposite ends thereof. Each of the pair of doors 92 and 94 includes suitable motive means (not shown) which selectively open and close the doors 92 and 94 in succession to permit the part carriers 30 to be introduced and removed from the modular housing 14 with only minimal cryogen atmosphere exposure.

The pre-freeze module 82 and both the primary and secondary blasting modules 84 and 86 are provided with piping means 100 and 102 which direct a suitable quantity of cryogen gas (such as nitrogen) into their interiors. In the preferred embodiment, the quantity of cryogen gas introduced through the piping means 100 and 102 is sufficient to raise the internal pressure within the modules 82, 84, and 86 to a value exceeding ambient atmospheric pressure such that when the interior doors 94 of the entry and exit modules 80 and 88, respectively, are selectively opened during operation, the pressure differential hinders any ambient air from traveling into the pre-freeze and blasting modules 82, 84, and 86, respectively.

Both the primary and secondary blasting modules 84 and 86 are provided with plural throwing wheel assemblies, 104*p* and 104*s*, respectively, which are preferably arranged in a vertically spaced orientation and mounted along a side wall of the insulated casing 70. The assemblies 104*p* and 104*s* are positioned to accelerate a deflashing media (not shown) in a uniform dispersed pattern throughout the interior of both the primary and secondary deflashing modules 84 and 86, such that the entire length of the articles 50 maintained upon the part carrier 30 are exposed to the high velocity media. The throwing wheel assemblies 104*p* and 104*s* are supplied a continuous quantity of deflashing media (not shown) from a respective media separator and storage hopper 106*p* and 106*s* through the media supply lines 108*p* and 108*s*. The detailed construction and operation of the throwing wheel assemblies 104*p* and 104*s*, the media separator/storage hoppers 106*p* and 106*s* and supply lines 108*p* and 108*s* is fully described in a co-pending patent application, Ser. No. 046,507, Filed June 7, 1979, by David Stearns et al (and assigned to Airmac Cryogenic Machinery Company, the assignee of the subject patent application), the disclosure of which is expressly incorporated herein by reference.

The lower portion of the pre-freeze 82 and both blasting modules 84 and 86 includes a generally V-shaped trough 110 adapted to accumulate the spent deflashing media after impact against the articles 50. The upper end of the trough 110 is provided with a grid 112 extending completely across its length which permits the spent deflashing media to pass into the trough 110 while accumulating the larger pieces of flash removed from the articles during the deflashing process. A separator unit 114 is additionally positioned adjacent the lower surface of the trough 110 being adapted to segregate the spent deflashing media accumulating within the trough 110 into two general sizes and return the segregated media into the appropriate storage reservoir 106*p* and 106*s* through the media return lines 116*p* and 116*s*. The separator unit 114 may additionally be provided with suitable flash/media separating means to remove any small particles of flash traveling past the grid 112 and insure that only deflashing media is transported back into the hoppers 106*p* and 106*s*.

As previously mentioned, the transport of the part carriers 30 through the deflashing housing 14 is provided by a plurality of individual transport mechanisms (designated generally by the numerals 120*a*, 120*b*, 120*c*, and 120*d* in FIG. 1), each formed in a similar manner, and positioned to extend over each of the individual modules 80–88 of the housing 14. (I.e., the mechanism 120*a* extends over the entry module 80, the mechanism 120*b* extends over the pre-freeze module 82 as well as primary blasting module 84, the mechanism 120*c* extends over the secondary blasting module 86, and the mechanism 120*d* extends over the exit module 88.) The detailed construction of the individual transport mechanisms 120*a*–120*d* is illustrated in FIG. 3 and will be described with particular reference to the transport mechanism 120*b*, it being recognized that the remaining mechanisms 120*a*, 120*c*, and 120*b* are constructed in the same manner.

As shown, the mechanism 120*b* is composed of a continuous conveyor chain 122, which extends between a pair of gear sprockets 124. The sprockets 124 are each mounted upon a shaft 126, which is journaled upon a pair of pillow blocks 128, rigidly mounted to the upper surface of the U-shaped channel or track 18. One of the sprocket shafts 126 is driven by means, such as a motor 130, through a suitable gear reduction unit 132. In the preferred embodiment, the rotational speed of the motor 130 may be varied during operation, thereby varying the translational speed of the chain drive 122 along the track 18.

The continuous conveyor chain 122 is provided with plural engagement tabs 136 which are spaced along its length and extend a short distance outward along one side thereof. As shown in FIG. 3, the engagement blocks 136 are adapted to extend downward a short distance with the U-shaped track 18 and engage the trailing edge of the trolley 34 of the part carriers 30, such that during rotation of the chain drive 122, the part carrier 30 is transported transversely along the length of the conveyor truck 18 between the sprockets 124.

Figure 6:
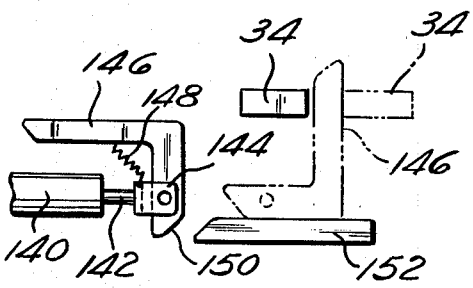
FIG. 6 is a schematic view of one of the transfer mechanisms of the present invention utilized to transfer the part carriers between each of the independent drive mechanisms of the conveyor transport.

To transfer the part carrier 30 between adjacent transport mechanisms 120*a*, 120*b*, 120*c*, and 120*d*, plural pneumatic operators 140*a*, 140*b*, 140*c*, 140*d*, and 140*e* are positioned on the track 18 adjacent the junction of the main conveyor drive 60 with the individual transfer mechanisms 120*a* and 120*e*, as well as at the junction between adjacent individual transport mechanisms 120*a*–120*d*. As best shown in FIGS. 3 and 6, each of the pneumatic operators 140 include a piston 142 which reciprocates back and forth in response to selective actuation of the cylinder 140. The piston 142 includes a clevis 144 rigidly mounted adjacent one end thereof, which pivotally mounts an L-shaped strut 146. The strut 146 is biased toward the cylinder 140 by a spring 148 and includes a tapered cam surface 150 at its outermost end. The cam surface 150 is vertically aligned with a cam plate 152 whereas the inner-most end of the strut 146 is registered with an elongate slot 154 (shown in FIG. 3) formed in the track 18.

By such an arrangement, selective actuation of the operator 140 causes the cam surface 150 to contact the cam plate 152. Due to the mating tapered configuration of the cam surface 150 and cam plate 152, this initial contact causes the L-shaped strut 146 to pivot within the clevis 144 from its full line position to the phantom line position, shown in FIG. 6. During this pivotal movement, the inner-most end of the strut 146 travels through the slot 154 formed in the track 18 and engages the trailing edge of the trolley 34. Continued extension of the cylinder 142 causes the trolley 34 to be transported laterally along the length of the track 18, thereby transferring the trolley 34 between adjacent transport mechanisms 120*a*–120*d*.

Subsequently, deactivation of the operator 140 causes the cylinder 142 to return back to its initial position wherein the L-shaped strut 146 disengages from the cam plate 152 and the spring 148 returns the strut 146 to its normal position. With the trolley 34 repositioned on the track 18 beneath the next adjacent transport mechanism 120, actuation of the respective transport mechanism 120 causes the engagement tab 136 to engage the trailing edge of the trolley 34 and transport the same transversely along the track 18. It will be recognized that the actuation of the individual transport mechanisms 120*a*–120*d* is synchronized, with the operation of the pneumatic operators 140, as well as with the main conveyor transport 60, such that multiple part carriers 30 may be transported through each of the modules 80, 82, 84, 86, and 88 of the housing 14.

The present invention additionally includes a novel rotating mechanism 160 which is positioned upon the conveyor track 18 at the locations corresponding to the center of both the primary and secondary blasting chambers 84 and 86, to selectively rotate the part carriers 30 during the blasting operation. As shown in FIGS. 3 and 4, the rotating mechanism 160 is composed of a pair of vertically spaced mounting plates 162 which are pivotally mounted adjacent one end to the conveyor track 18 by a pivot pin 164 and connected to a pneumatic operator 166 adjacent their opposite end. A large disk 170 is rotably mounted between the plates 162, the periphery of which engages a drive wheel 172 connected to a suitable motor drive 174. The drive wheel 172 is constantly biased toward the disk 170 such that their peripheries tightly abut one another and rotation of the drive wheel 172 causes a corresponding rotation of the disk 170.

An L-shaped support arm 176 is pivotally attached to the upper plate 162 and extends upward and over the conveyor track 18. The distal end of the support arm 174 is pivotally connected to a linkage 178 which is additionally pivotally connected midway along its length to a mounting flange 180 attached to the upper surface of the conveyor track 18. The lower-most end of the linkage 178 mounts a pair of capstans 182 which can laterally spaced from one another and adapted to freely rotate about their respective axis. Both the disk 170 and capstans 182 are vertically aligned with an access slot 190 and 192, respectively, formed on opposite sides of the conveyor track 18.

With an individual part carrier 30 transversely aligned with the rotation mechanism 160, actuation of the pneumatic operator 166 will cause the pair of plates 162 to pivot about the pin 164 inwardly toward the conveyor track 18. During this inward travel, the disk 170 extends through the slot 190 formed in the track 18 and contacts the upper disk 40, positioned on the part trolley 34. Simultaneously, the linkage 178 is pivoted about the mounting flange 180, causing the capstans 182 to extend through the slot 192 formed in the track 18 and tightly bias the upper disk 40 on the trolley 34 between the peripheries of the disk 170 and capstans 182. Positioned in such a manner, rotation of the drive wheel 172 causes a corresponding rotation of the upper disk 40 which is transmitted to the rod 32 of the part carrier 30 such that the individual articles maintained upon the part carrier 30 are rotated within the blasting modules 86 and 88. Correspondingly, deactivation of the pneumatic operator 166 causes the disk 170 and capstans 182 to retract outwardly through the slots 190 and 192, respectively, to their normal position indicated in FIG. 4, wherein the trolley 34 of the part carrier 30 may be transported transversely through the length of the conveyor track 18.

With the structure defined, the operation of the continuous cryogenic deflashing apparatus 10 of the present invention may be described. For purposes of illustration, the operation of the apparatus will be described in relation to a particular part carrier 30 as it successively travels through each of the individual modules 80–88 of the apparatus. However, it will be recognized that in actual operation, each of the modules receives a respective part carrier 30 such that the operations within each of the modules occur simultaneously.

Initially, the articles 50 to be deflashed are manually applied to the part carrier 30 at a location upon the track 18 substantially spaced or remote from the entry module 80. Due to this spaced separation between the loading station and the entry module 80, exposure of the cryogen environment maintained within the housing 14 to operating personnel is eliminated. Once located upon the carrier 30, activation of the main conveyor drive mechanism 60 causes the part carrier 30 to travel from left to right (as viewed in FIG. 1), toward the entry module 80.

As the trolley 34 of the carrier 30 passes beneath the end of the main drive mechanism 60, the pneumatic operator **140*a* is selectively energized wherein the trolley 34 is transferred by the L-shaped strut 146 from the main conveyor drive 60 to reside beneath one of the sprockets 124 of the first individual transport mechanism 120*a*. The operation of the first individual transport mechanism 120*a* is synchronized or timed with the operation of the main conveyor drive mechanisms 60 and pneumatic operator 140 such that during this transfer, an appropriate engagement block 136 of the transport mechanism 120*a* engages the trailing edge of the trolley 34 to transport the part carrier 30 along the track 18**.

Continued transport of the carrier 30 along the track 18 enters the bearing 42, disposed on the lower end of the rod 32 of the carrier 30, between the spaced guide rails 44 mounted in the deflashing chamber 12 while the upper end of the rod 32 enters between the pair of inflatable seals 23 disposed on the lower end of the track 18. Due to the engagement of the bearing 42 between the spaced guide rails 44, and the trolley 34 within the track 18, it will be recognized that the part carrier 30 is supported at opposite ends during travel through the modular deflashing housing 14.

As the carrier 30 approaches the entry module 80, the outer pivotal doors 92 on the entry module 80 are selectively driven into an open position, as indicated in FIG. 1, so that the part carrier 30, driven by the individual transport mechanism **120*a*, may be transported into the interior of the entry module 80. During this entry, the inner doors 94 of the entry module 80 remain closed thereby preventing any direct interaction between the cryogen environment maintained within the pre-freeze module 82 and the ambient atmosphere existing in the entry module 80. Once entered therein, the outer doors 92 are driven back to their closed position, thereby isolating the interior of the entry module 80 from ambient air while the individual transport mechanism 120*a* continues to transport the carrier 30 toward the pre-freeze module 82**.

When the carrier 30 passes beneath the distal sprocket 124 of the first individual transport mechanism **120*a*, the respective pneumatic operator 140*b* is energized to engage the trolley 34, in a manner previously described, and transfer the same to a position wherein the next individual transport mechanism 120*b* may engage the trailing edge of the trolley 34. During this transfer of the trolley 34, the inner doors 94 of the entry module 80 are selectively driven to an open position, so that the part carrier 30 may be transported into the pre-freeze module 82. Due to the cryogen atmosphere within the pre-freeze module 82 being at a pressure greater than that of ambient atmosphere, an effective pressure barrier exists between the pre-freeze module 82 and the entry module 80 which hinders the migration of ambient air contained within the entry module 80 into the pre-freeze module 82. Further, due to the inflatable seal 23, and an enlarged washer seal 23 tightly engaging the rod 32 of the carrier 30 adjacent the track 18, escape of the cryogen atmosphere upward through the track 18** and into the plant facility is prohibited.

With the carrier 30 positioned in the pre-freeze module 82, the inner doors of the entry module 80 are returned to their normally closed position, and the exposure of the cryogen environment to the molded articles causes the residual flash thereon to rapidly become embrittled. Due to the independent motor drives and speed controls of the individual conveyor transports **120*a*–120*d*, the time duration of the articles 50 within the pre-freeze module 82 may be varied during operation to insure that any relatively large pieces of residual flash upon the articles are sufficiently embrittled prior to entry into the blasting modules 84 and 86**.

From the pre-freeze module 82, the part carrier 30 is transported by the individual transport mechanism **120*b* into the primary blasting module 84 and subsequently positioned to be registered with the first rotating mechanism 160*p*. With the carrier 30 positioned in such a manner, the pneumatic operators 166 of the rotating mechanism 160*p* is selectively energized causing the disk 170 and pair of capstans 182 to engage the drive disk 40 of the carrier 30. Actuation of the motor drive 174 causes the drive disk 40 and thus the part carrier rod 32 to slowly rotate in the direction of the arrow in FIG. 2, thereby exposing all of the multiple articles 50 contained upon the part carrier 30 directly with the high velocity deflashing media being propelled from the throwing wheel assemblies 140***p*.

In the preferred embodiment, the deflashing media (not shown), propelled by the throwing wheel assemblies 104*p* in the blasting chamber 84, is selected to be of a relatively large size to rapidly break off or remove the majority of the residual flash from the article 50. Typically, the flash removed from the articles 50 in this primary blasting operation is of a relatively large size and falls by gravity force downward upon the grate 112. As such, the residual flash removed during the primary blasting process does not shield the articles 50 from the blasting media, as in the prior art tumbling devices, and thus optimizes the removal of flash from the articles 50.

After a sufficient period of time within the primary blasting chamber 84, the first rotating mechanism 160*p* is deactivated, whereby the enlarged disk 170 and capstans 182 disengage from the drive disk 40 of the part carrier 30, and retract from the interior of the track 18. The part carrier 30 is then transported toward the secondary blasting module 86. During this travel, the respective pneumatic operator 140*c* is selectively energized causing the trolley 34 of part carrier 30 to be transferred to the next independent transport mechanism 140*c*. The part carrier 30 is subsequently transported by the independent drive mechanism 140*c* to a registered position with a second rotating mechanism 160*s* located in the secondary blasting module 86. Once registered, the second rotating mechanism 160*s* is actuated, in the same manner as described in reaction to the first rotating mechanism 160*p*, causing the part carrier 30 to slowly rotate thereby exposing the articles 50 to the deflashing media being introduced into the blasting chamber 86 by the secondary blasting wheel assemblies 104*s*. In the preferred embodiment, the deflashing media (not shown), supplied through the secondary throwing wheel assemblies 104*s*, is of a smaller size than the deflashing media supplied to the primary throwing wheel assemblies 140*p*, and is utilized to remove the remaining residual flash upon the articles 50 without marring the surface finish of the articles 50.

As will be recognized, due to the independent motor drives 130 on each of the independent drive mechanisms 120*a*–120*d*, the exposure time of the articles 50 within the primary blasting module 84 and secondary blasting module 86 may be selectively varied during operation. As such, the apparatus may be readily adjusted to optimize the flash removal in each of the modules 84 and 86 and thus maximizing the efficiency of the deflashing operation.

Subsequent to the blasting process within the secondary blasting module 86, the second rotating mechanism 160*s* is deactivated, and the part carrier 30 is transported toward the exit module 88 and transferred by actuation of the respective pneumatic transfer operator 140*d* to be engaged by the next independent drive mechanism 120*d*. During this transfer, the inner doors 94 of the exit module 88 are driven to an open position, while the outer doors 92 remain closed, thereby permitting the part carrier 30 to travel into the exit module 88 while eliminating any direct interaction between ambient air and the cryogen environment. Positioned within the exit module 88, the inner doors 94 are then selectively closed, and the outer doors 92 selectively opened, whereby the carrier 30 is transported out of the modular flashing housing 14, to reside adjacent the main conveyor drive mechanism 60. The respective pneumatic transfer operator 140*e* is then selectively energized causing the carrier 30 to be transferred beneath and engaged by the main conveyor drive 60. With the carrier 30 driven by the main conveyor drive 60, continued transport causes the bearing 42 disposed upon the lower end of the shaft 32 of the part carrier 30 to disengage from the pair of space guide rails 44 and the carrier 30 to be transported away from the deflashing housing 14 in a direction indicated by the arrow in FIG. 1.

Advantageously, the remaining length of the conveyor track 18 (i.e., between the entry and exit modules 80 and 88) may be utilized for inspection and removal of the deflashed articles 50 from the part carrier 30, with the empty part carriers 30 being transported by the main conveyor drive 60 back toward the loading station where they may again be transported through the deflashing housing 14.

From the above, it will be recognized that the present invention comprises a novel deflashing apparatus wherein the successive operations of entry, pre-freezing, primary blasting, secondary blasting, and exit occur simultaneously as multiple part carriers 30 travel serially through the deflashing housing 14. Such serial and simultaneous operations permit continuous deflashing of the articles 50, thereby optimizing apparatus productivity. Additionally, the multiple independent transport mechanisms utilized through each of the modules of the apparatus permit various sized and part configuration articles to be accommodated with only minor adjustment of the apparatus.

Those skilled in the art will recognize that the modular deflashing housing of the present invention may be modified to include more or less discrete operational modules to accommodate articles of varying sizes and configurations without departing from the spirit of the present invention.

What is claimed is:

1. A method of optimizing the continuous cryogenic removal of residual flash from molded articles comprising the sequential steps of:

(1) transporting said molded articles into an isolated entry station in a housing to serve as a buffer region to prevent interaction between the ambient air and a cryogenic environment;

(2) transporting said molded articles from said entry station into a pre-freezing station in said housing maintained at a pressure higher than ambient atmospheric pressure to hinder ambient air from traveling into said pre-freezing station and a cryogenic temperature to embrittle said residual flash;

(3) transporting said molded articles from said pre-freezing station to a first deflashing station maintained at the higher pressure of said pre-freezing station and dispersing a first deflashing media at a high velocity to impinge against said molded articles, said media being of a first size sufficient to remove the majority of said embrittled residual flash on said article;

(4) transporting said molded articles from said first deflashing station to a second deflashing station maintained at said higher pressure and dispersing a second deflashing media at a high velocity to impinge against said molded articles, said media being of a second size smaller than said first size to remove the remaining embrittled residual flash on said articles; and (5) transporting said deflashed articles from the second deflashing station to an exit station isolated from the cryogenic environment and the ambient atmosphere.

* * * * *